US006234866B1

(12) United States Patent
Ben-Yakar et al.

(10) Patent No.: US 6,234,866 B1
(45) Date of Patent: May 22, 2001

(54) TOY VEHICLE

(76) Inventors: Eliyahu Ben-Yakar, 58 Hameginim Street, Herzlia (IL); Omri Rothshild, 32 Avner Street, Zahala, Tel Aviv (IL); Roni Raviv, 13 Dalia Street, Nes Ziona 74061 (IL)

( * ) Notice: Subject to any disclaimer, the term of this patent is extended or adjusted under 35 U.S.C. 154(b) by 0 days.

(21) Appl. No.: 09/209,222

(22) Filed: Dec. 11, 1998

(51) Int. Cl.[7] ..... A63H 17/00
(52) U.S. Cl. ..... 446/431; 446/454
(58) Field of Search ..... 446/431, 434, 446/454, 456, 460, 465, 468, 470, 457; 280/1.182, 218

(56) References Cited

U.S. PATENT DOCUMENTS

| | | | | |
|---|---|---|---|---|
| 3,623,566 | * | 11/1971 | Orloff | 446/456 |
| 3,765,693 | * | 10/1973 | Morrison et al. | 280/1.182 |
| 4,187,637 | * | 2/1980 | Nielsen | 446/454 |
| 4,466,215 | * | 8/1984 | Hanazato | 2810/1.182 |
| 4,696,655 | | 9/1987 | D'Andrade et al. | 446/330 |
| 4,822,316 | | 4/1989 | Shaffer et al. | 446/446 |
| 4,969,851 | | 11/1990 | Rasmussen | 446/444 |
| 5,259,808 | | 11/1993 | Garr | 446/437 |
| 5,482,494 | | 1/1996 | Ishimoto | 446/456 |
| 5,667,420 | | 9/1997 | Menow et al. | 446/433 |
| 5,674,105 | * | 10/1997 | Hamlin | 446/457 |
| 5,692,737 | * | 12/1997 | Perlsweig | 446/431 |
| 5,785,576 | * | 7/1998 | Belton | 446/456 |
| 5,803,790 | | 9/1998 | Tilbor et al. | 446/470 |
| 5,830,038 | * | 11/1998 | Fekete et al. | 446/460 |

* cited by examiner

*Primary Examiner*—Sam Rimell
(74) *Attorney, Agent, or Firm*—Ladas & Parry

(57) ABSTRACT

The present invention is addressed to a toy wheeled vehicle having a high degree of flexibility and versatility. The vehicle is provided with a forward wheeled axle, a rearward wheeled axle, and a resilient coupling in the form of a coil spring connecting the forward wheeled axle to the rearward wheeled axle. The coupling permits multiple degrees of freedom between the forward wheeled axle and the rearward wheeled axle. The wheels are driven by motors which may be remotely controlled.

11 Claims, 5 Drawing Sheets

TOY VEHICLE

FIELD OF THE INVENTION

The present invention relates to toy vehicles generally

BACKGROUND OF THE INVENTION

Various types of toy vehicles are known in the art. Flip over vehicle are shown, for example, in U.S. Pat. Nos. 4,969,851; 5,259,808 and 5,667,420. Toy vehicles having hinged chassis assemblies are shown, for example, in U.S. Pat. Nos. 4,696,655 4,822,316; 5,492,494 and 5,803,790.

SUMMARY OF THE INVENTION

The present invention seek to provide an improved toy vehicle which has an extremely high degree of flexibility and versatility.

There is thus provided in accordance with a preferred embodiment of the present invention a toy vehicle including at least one forward wheeled axle, at least one rearward wheeled axle and a resilient coupling connecting the at least one forward wheeled axle and the at least one reward wheeled axle with more than one degree of freedom therebetween.

Preferably, the resilient coupling includes an elongate springs.

In accordance with a preferred embodiment of the present invention, the resilient coupling includes a coil spring extending when in a rest orientation, generally perpendicular to the at least one forward wheeled axle and to the at least one rearward wheeled axle.

Preferably, the toy vehicle is operative for wheeled translation both in a first orientation and in a second orientation upside down of the first orientation.

In accordance with a preferred embodiment of the present invention, each of the at least one forward wheeled axle and the at least one rearward wheeled axle includes a pair of wheels, each wheel being independently controllable.

Preferably, each wheel is associated with a separate motor, thereby providing steering of the vehicle by individual speed control of the wheels.

In accordance with a preferred embodiment of the present invention, at least one of the at least one forward wheeled axle and at last one rearward wheeled axle is a non-rigid axle.

Preferably, the resilient coupling connecting the at least one forward wheeled axle and the at least one rearward wheeled axle has more than two degrees of freedom therebetween.

More preferably, the resilient coupling connecting the at least one forward wheeled axle and the at least one rearward wheeled axle has more than three degrees of freedom therebetween.

Even more preferably, the resilient coupling connecting the at least one forward wheeled axle and the at least one rearward wheeled axle has more than four degrees of freedom therebetween.

Yet more preferably, the resilient coupling connecting the at least one forward wheeled axle and the at least one rearward wheeled axle has more than five degrees of freedom therebetween.

Still more preferably, the resilient coupling connecting the at least one forward wheeled axle and the at least one rearward wheeled axle has more than six degrees of freedom therebetween.

BRIEF DESCRIPTION OF THE DRAWINGS

The present invention will be more fully understood and appreciated from the Following detailed description, taken in conjunction with the drawings in which.

DETAILED DESCRIPTION OF PREFERRED EMBODIMENTS

Figure 1:
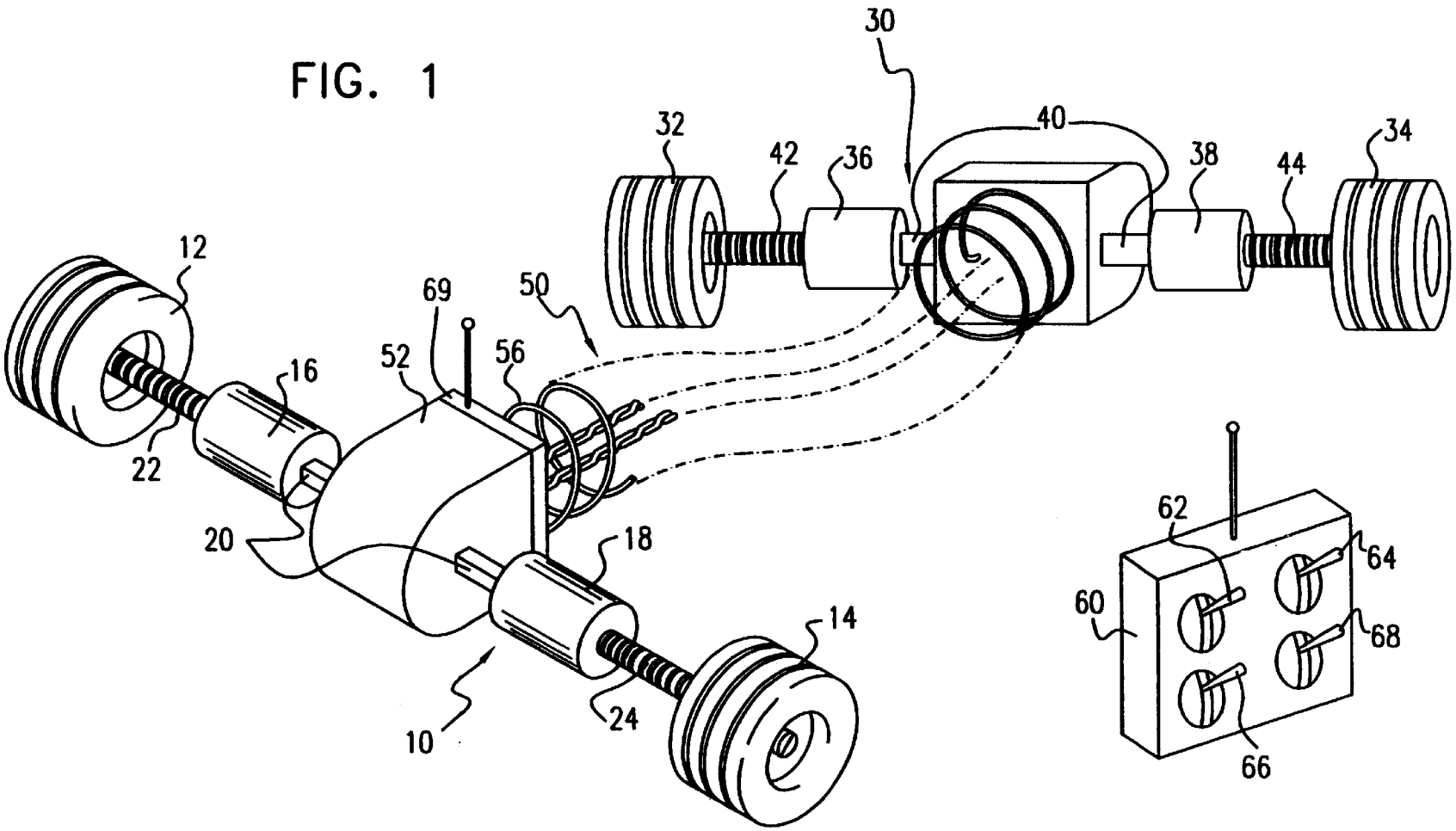
FIG. 1 is a pictorial illustration of a toy vehicle constructed and operative in accordance with a preferred embodiment of the present invention in a torqued orientation.
Figure 2:
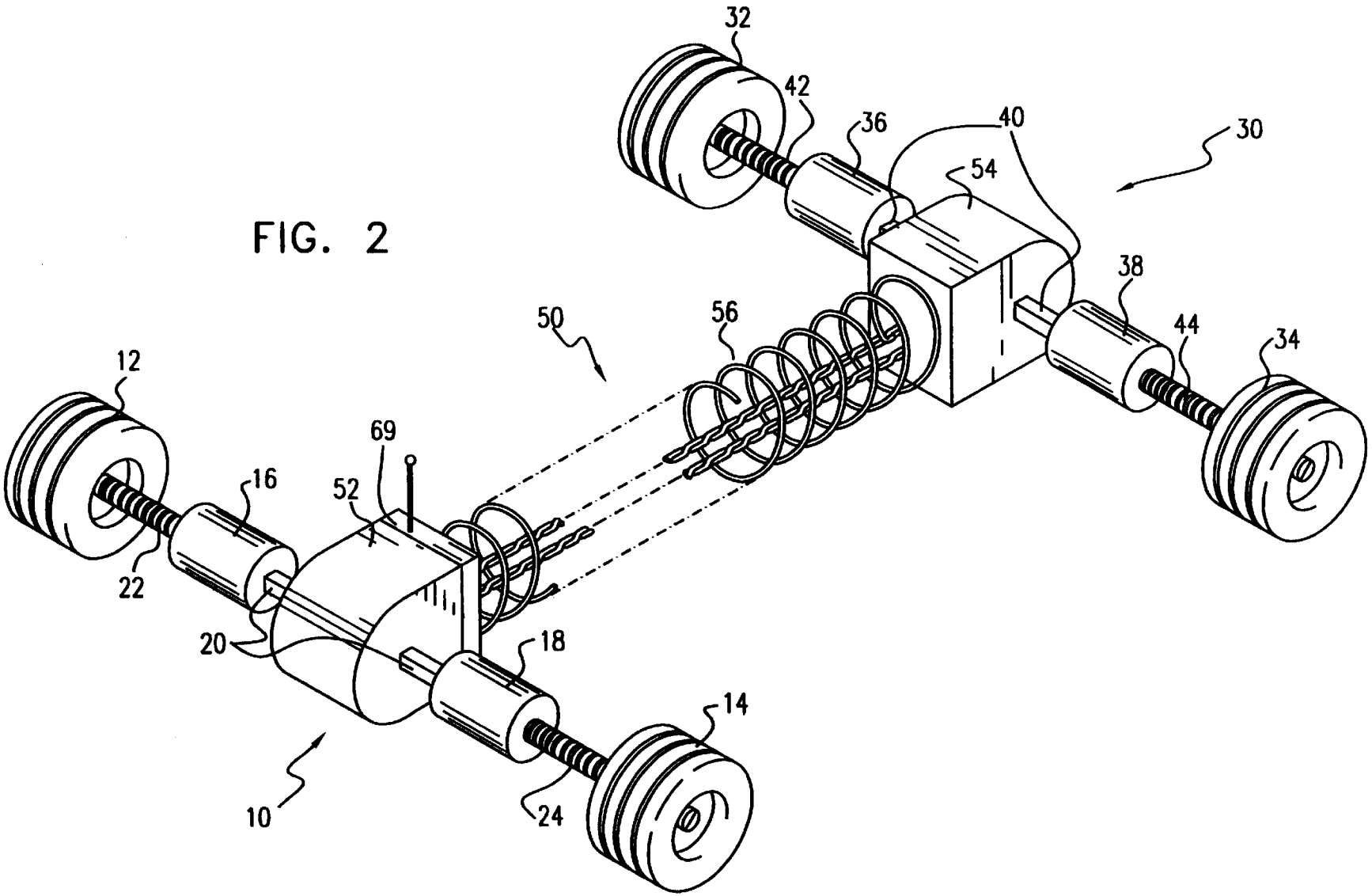
FIG. 2 is a pictorial illustration of the toy vehicle of FIG. 1 is a typical at-rest orientation.

Reference is now made to FIGS. 1 and 2, which illustrate a toy vehicle constructed and operative in accordance with a preferred embodiment of the present invention. The toy vehicle preferably comprises a forward wheeled axle lo having mounted thereon first and second forward wheels 12 and 14, each of which is preferably driven by a separate electric motor, designated respectively by reference numerals 16 and 18.

The motors 16 and 18 are preferably connected together by a mounting element 20. Shaft 20 is typically generally rigid but may alternatively be Gloible and resilient. Alternatively, the wheels 12 and 14 may be connected together by mounting element 20 and the motors may be attached to the shaft.

Motors 16 and 18 are preferably connected to respective wheels 12 and 14 by respective shafts 22 and 24. Shafts 22 and 24 may be rigid or alternatively flexible and/or stretchable.

The toy vehicle also preferably comprises a rearward wheeled axle wheeled axle 30 having mounted thereon first and second rearward wheels 32 and 34, each of which is preferably driven by a separate electric motor, designated respectively by reference numerals 36 and 38.

The motors 36 and 38 are preferably connected together by a mounting element 40. Shaft 40 is typically generally rigid but may alternatively be flexible and resilient. Alternatively, the wheels 32 and 34 may be connected together by mounting element 40 and the motors may be mounted to the shaft.

Motors 36 and 38 are preferably connected to respective wheels 32 and 34 by respective shafts 42 and 44. Shafts 42 and 44 may be rigid or alternatively flexible and/or stretchable.

In accordance with a preferred embodiment of the present invention, a resilient coupling 50 connects the forward wheeled axle 10 and the rearward wheeled axle 30 via respective axle mounts 52 and 54 with more than one degree of freedom therebetween. Preferably, the resilient coupling 50 provides more than two degrees of freedom. In a most preferred embodiment of the invention, the resilient coupling 50 provides six degrees of freedom. Additional degrees of freedom may be realized if mounting elements 20 and 40 are flexible and resilient.

A preferred embodiment of resilient coupling 50 comprises an elongate coil spring 56 which allows relative translation of wheeled axles 10 and 30 along three mutually perpendicular axes and allows relative pitch, yaw and roll thereof.

According to an alternative embodiment of the invention, electric motors may be provided only on one of the forward and rearward wheeled axles 10 and 30. In such a case the remaining wheels are relatively freely rotating.

In accordance with a preferred embodiment of the present invention, a radio controller 60 is provided with independent speed and direction controls 62, 64, 66 and 68 for each of motors 12, 14, 32 and 34, thus providing vehicle steering control as well as speed control via a radio receiver and motor driver 69. Alternatively, the toy vehicle can be operated without a remote control and may employ one or more motors to drive one or more of the wheels.

It is seen that FIG. 1 shows the vehicle with resilient coupling so in a torqued orientation, while FIG. 2 shows the vehicle with resilient coupling 50 in an at-rest orientation.

Figure 3:
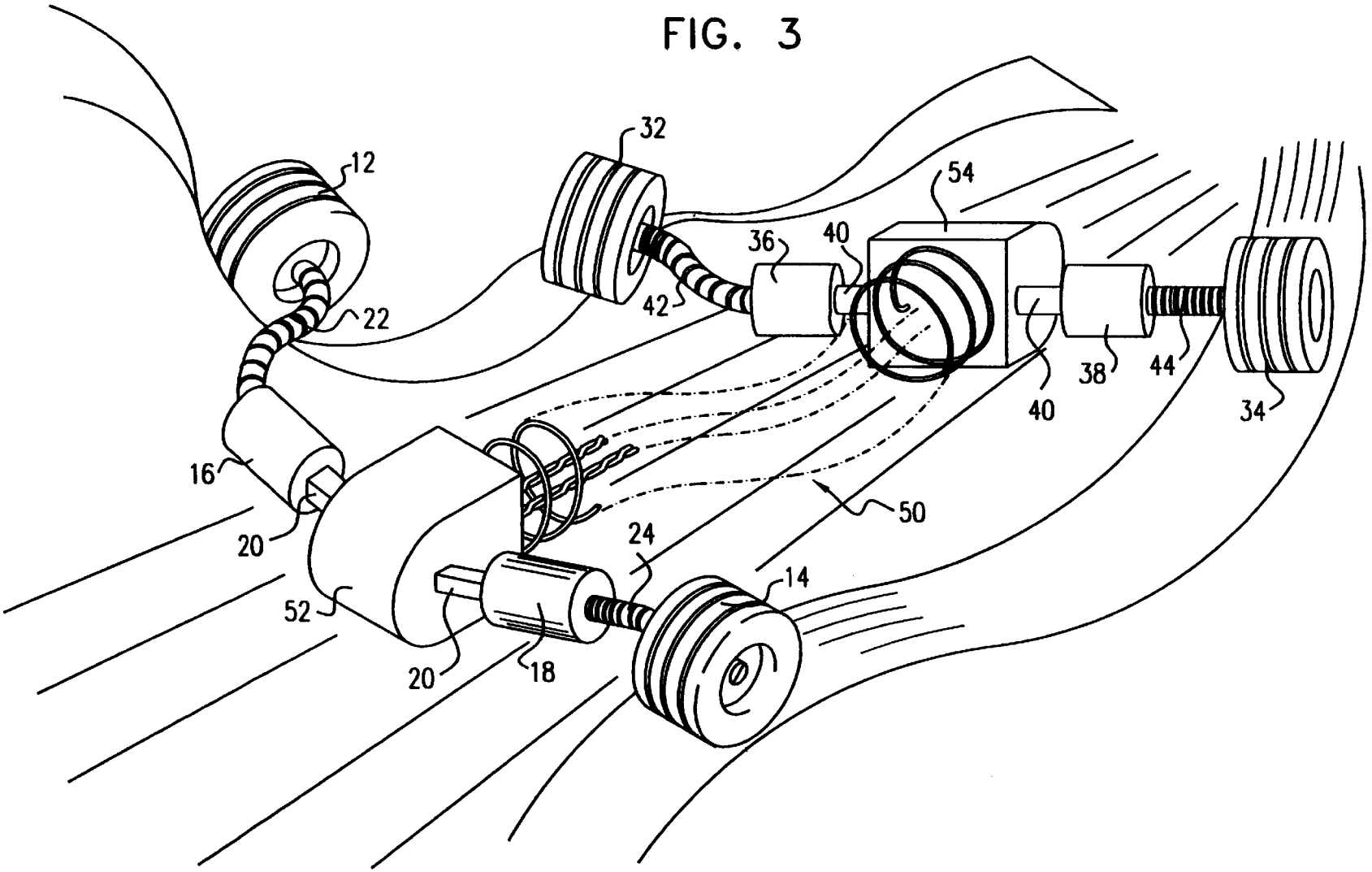
FIG. 3 is a pictorial illustration of a toy vehicle constructed and operative in accordance with another preferred embodiment of the present invention in a torqued orientation.

Reference is now made to FIG. 3, which is a pictorial illustration of a toy Vehicle constructed and operative in accordance with another preferred embodiment of the present invention in a torqued orientation. In the illustration of FIG. 3 it is seen that not only is resilient coupling 50 torqued, but also at least some of shafts 22, 24, 32 and 34 are also torqued and/or extended. The illustrated flexibility of design enables the toy vehicle to travel over extremely rough and varied terrain.

Figure 4A:
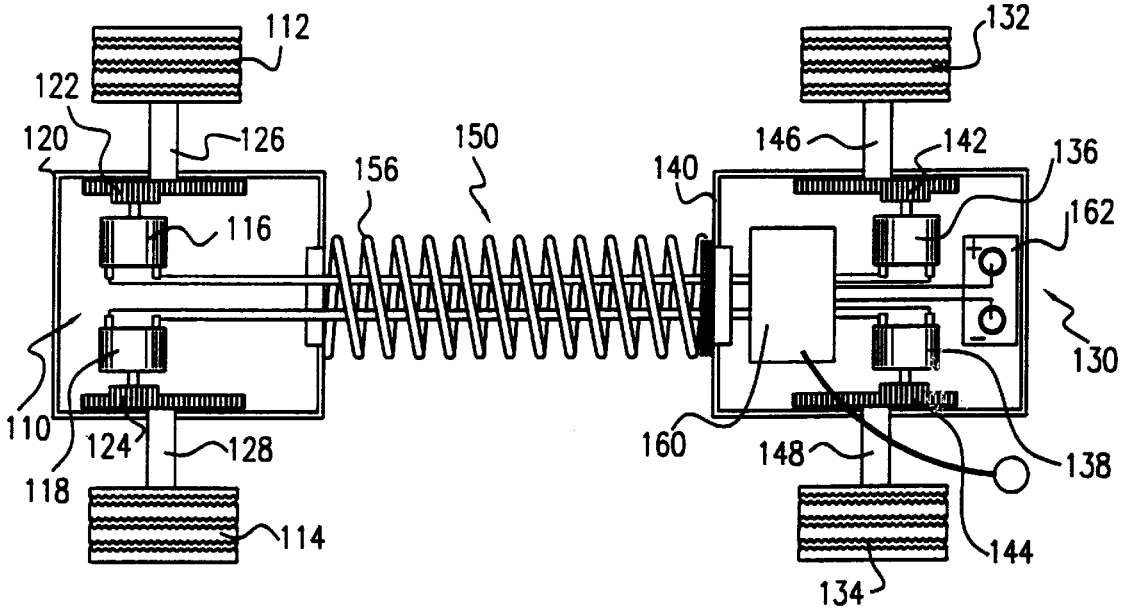
FIGS. 4A and 4B are pictorial illustrations of two alternative embodiments of a toy vehicle constructed and operative in accordance with the present invention.
Figure 4B:
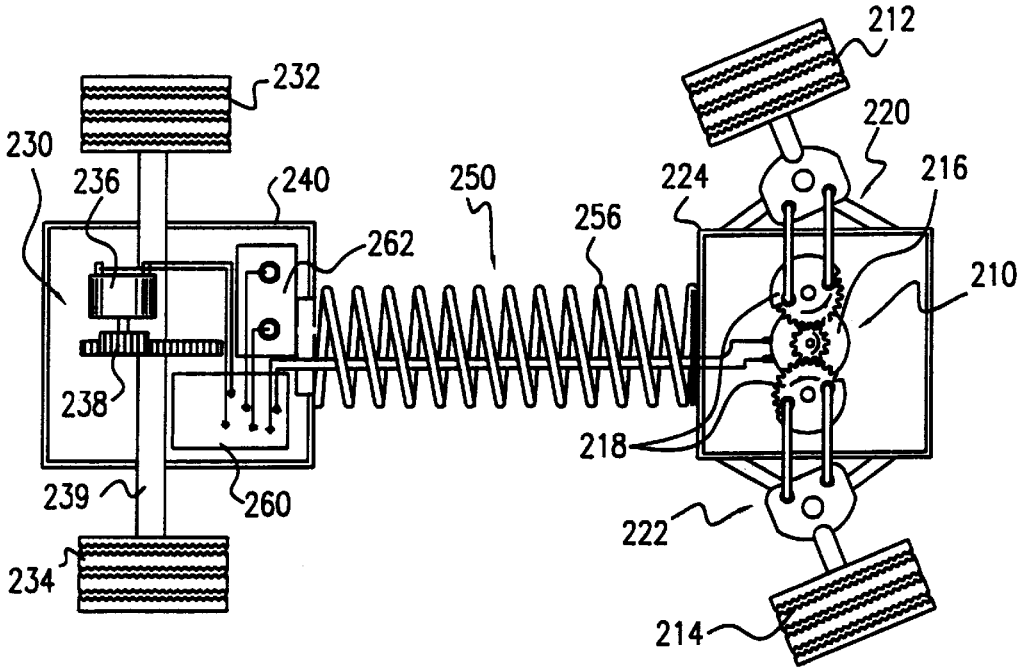

Reference is now made to FIGS. 4A and 4B, which are pictorial illustrations of two alternative embodiments of a toy vehicle constructed and operative in accordance with the present invention. It is appreciated that the vehicles of FIGS. 4A and 4B, as well as all the other vehicles described herein may be operated with what is the forward axle being located rearwardly and vice versa. Thus it is to be understood that the designations of forward and rearward may be taken to be arbitrary.

The embodiment of FIG. 4A, which is the most preferred embodiment, preferably comprises a forward wheeled axle 110 having mounted thereon first and second forward wheels 112 and 114, each of which is preferably driven by a separate electric motor, designated respectively by reference numerals 116 and 118.

The motors 116 and 118 are preferably mounted in a housing 120 and are coupled via respective gear assemblies 122 and 124 and respective shafts 126 and 128 to wheels 112 and 114. Shafts 126 and 128 are typically generally rigid but may alternatively be flexible and resilient. Alternatively, the wheels 112 and 114 may be rotatably connected to shafts and the motors may be mounted to the shafts.

The toy vehicle also preferably comprises a rearward wheeled axle 130 having mounted thereon first and second wheels 132 and 134, each of which is preferably driven by a separate electric motor, designated respectively by reference numerals 136 and 138.

The Motors 136 and 138 are preferably mounted in a housing 140 and are coupled via respective gear assemblies 142 and 144 and respective shafts 146 and 148 to wheels 132 and 134. Shafts 146 and 148 are typically generally rigid but may alternatively be flexible and resilient. Alternatively, the wheels 132 and 134 may be rotatably connected to shafts and the motors may be mounted on the shafts.

In accordance with a preferred embodiment of the present invention, a resilient coupling 150 connects the forward wheeled axle 110 and the rearward wheeled axle 130 via respective housings 120 and 140 with more than one degree of freedom therebetween. Preferably,the resilient coupling 150 provides more than two degrees of freedom. In a most preferred embodiment of the invention, the resilient coupling 150 provides six degrees of freedom. Additional degrees of freedom may be realized if one or more of shafts 126, 128, 146 and 148 are flexible, stretchable and/or resilient.

A preferred embodiment of resilient coupling 150 comprises an elongate coil spring 156 which allows relative translation of wheeled axles 110 and 130 along three mutually perpendicular axes and allows relative pitch, yaw and roll thereof.

In accordance with a preferred embodiment of the present invention, a radio controller (not shown) may be provided with independent speed and direction controls for each of the motors. Such a radio controller way communicate with a radio receiver and motor driver 160 which receives electrical power from a battery 162 and provides electrical power to the motors 116, 118, 136 and 136. Alternatively, the toy vehicle can be operated without a remote control.

It is seen that FIG. 4A shows the vehicle with resilient coupling 150 in an at-rest orientation, it being appreciated that alternatively, the resilient coupling may be torqued in one or more directions.

The embodiment of FIG. 4B preferably comprises a forward wheeled axle 210 having mounted thereon first and second forward wheels 212 and 214, which are preferably steerable by a steering motor 216 via a gear assembly 218 and respective link ages 220 and 222.

The motor 216 is preferably mounted in a housing 224. Linkages 220 and 222 are typically generally rigid but may alternatively be flexible and resilient.

The vehicle of FIG. 4B also comprises a rearward wheeled axle 230 having mounted thereon first and second rearward wheels 232 and 234, both of which are driven by a single electric motor 236 via a gear assembly 238 and a common shaft 239. The motor 236 is preferably mounted in a housing 240.

Shaft 239 is typically generally rigid but may alternatively be flexible, extendible and/or resilient.

In accordance with a preferred embodiment of the present invention, a resilient coupling 250 connects the forward wheeled axle 210 and the rearward wheeled axle 230 via respective housings 224 and 240 with more than one degree of freedom therebetween. Preferably, the resilient coupling 250 provides more than two degrees of freedom. In A most preferred embodiment of the invention, the resilient coupling 250 provides six degrees of freedom. Additional degrees of freedom may be realized if one or more of shaft 239 and linkages 220 and 222 at flexible, stretchable and/or resilient.

A preferred embodiment of resilient coupling 250 comprises an elongate coil spring 256 which allows relative translation of wheeled axles 210 and 230 along three mutually perpendicular axes and allows relative pitch, yaw and roll thereof.

In accordance with a preferred embodiment of the present invention, a radio controller (not shown) may be provided with independent speed and direction controls for each of the motors. Such a radio controller may communicate with a radio receiver and motor driver 260 which receives electrical power from a battery 262 and provides electrical power to the motors 216 and 236. Alternatively, the toy vehicle can be operated without a remote control.

It is seen that FIG. 4B shows the vehicle with resilient coupling 250 in an at-rest orientation, it being appreciated that alternatively, the resilient coupling may be torqued in one or more directions.

Figure 5:
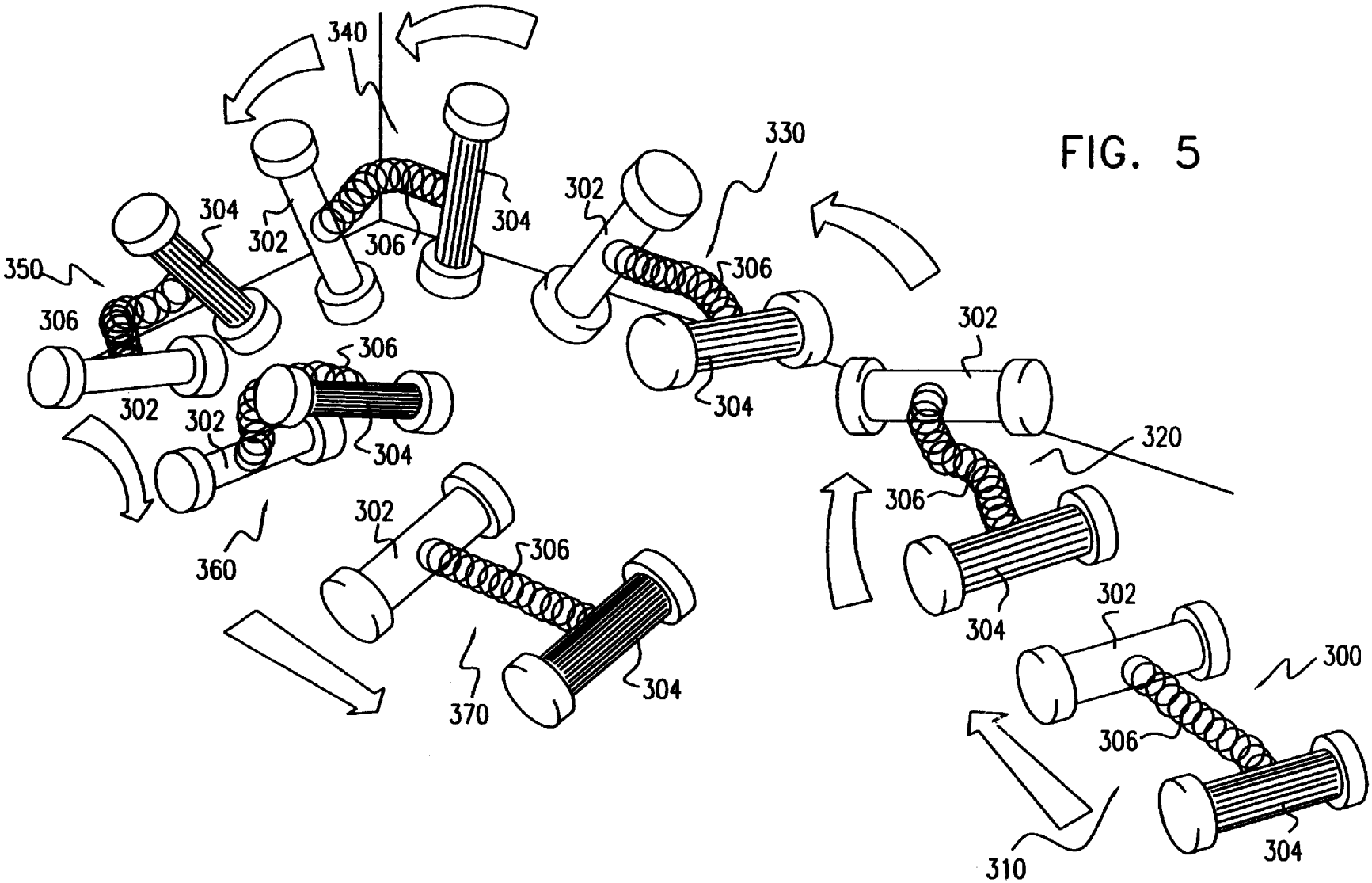
FIG. 5 is a composite pictorial illustration of a toy vehicle constructed and operative in accordance with a preferred embodiment of the present invention in a plurality of different orientations showing the various degrees of freedom of relative movement between the forward and rearward axles.

Reference is now made to FIG. 5, which is a composite pictorial illustration of a toy vehicle 300 constructed and operative in accordance with a preferred embodiment of the present invention in a plurality of different orientations showing the various degrees of freedom of relative movement between the forward and rearward axles. Vehicle 300 may be a vehicle comprising any desired combination of the features described hereinabove with reference to FIGS. 1–4B.

Typically, the vehicle 300 comprises first and second wheeled axles 302 and 304, at least one of which is motor driven, joined by a resilient coupling 306.

Reference numeral 310 designates the vehicle 300 in a typical orientation on a flat surface wherein resilient coupling 306 is in an untorqued orientation. Reference numeral 320 shows engagement of the vehicle 300 with a wall and consequent torquing of resilient coupling 306, producing bending thereof generally in two dimensions.

Reference numeral 330 shows wheeled axle 302 at least partially riding on one wall and the resilient coupling 306 torqued so as to be bent generally in three dimensions.

Reference numeral 340 shows both wheeled axles 302 and 304 both riding walls which are angled with respect to each other, while reference numeral 350 shows the vehicle 300 about to flip over as it begins to disengage from the wall.

Reference numeral 360 shows vehicle 300 flipping over and reference numeral 370 shows vehicle 300 entirely flipped over with the resilient coupling 306 it a generally untorgued at-rest orientation.

It will be appreciated by persons skilled in the art that the present invention is not limited to what has been particularly shown and described hereinabove. Rather the scope of the present invention includes combinations and subcombinations of the various features described hereinabove as well as modificatians and variations thereof which would occur to a person skilled in the art upon reading the foregoing description and which are not in the prior art.

What is claimed is:

1. A toy vehicle comprising:

at least one forward wheeled axle assembly defining a first attachment location;

at least one rearward wheeled axle assembly defining a second attachment location; and a coil spring connecting said at least one forward wheeled axle assembly and said at least one rearward wheeled axle assembly at said first and second attachment locations with more than one degree of freedom therebetween.

2. A toy vehicle according to claim 1 and wherein said a coil spring extends in a rest orientation generally perpendicular to said at least one forward wheeled axle assembly and to said at least one rearward wheeled axle assembly.

3. A toy vehicle according to claim 1 and wherein said toy vehicle is operative for wheeled translation both in a first orientation and in a second orientation upside down of said first orientation.

4. A toy vehicle according to claim 1 and wherein each of said at least one forward wheeled axle assembly and said at least one rearward wheeled axle assembly comprises a pair of wheels, each wheel being independently controllable.

5. A toy vehicle according to claim 4 and wherein each wheel is associated with a separate motor.

6. A toy vehicle according to claim 4 and wherein at least one of said at least one forward wheeled axle assembly and at least one rearward wheeled axle assembly is a non-rigid axle.

7. A toy vehicle according to claim 1 and wherein said resilient coupling connecting said at least one forward wheeled axle assembly and said at least one rearward wheeled axle assembly has more than two degrees of freedom therebetween.

8. A toy vehicle according to claim 1 and wherein said resilient coupling connecting said at least one forward wheeled axle assembly and said at least one rearward wheeled axle assembly has more than three degrees of freedom therebetween.

9. A toy vehicle according to claim 1 and wherein said resilient coupling connecting said at least one forward wheeled axle assembly and said at least one rearward wheeled axle assembly has more than four degrees of freedom therebetween.

10. A toy vehicle according to claim 1 and wherein said resilient coupling connecting said at least one forward wheeled axle assembly and said at least one rearward wheeled axle assembly has more than five degrees of freedom therebetween.

11. A toy vehicle according to claim 1 and wherein said resilient coupling connecting said at least one forward wheeled axle assembly and said at least one rearward wheeled axle assembly has more than six degrees of freedom therebetween.

* * * * *